US011107331B2

(12) United States Patent
Aoki et al.

(10) Patent No.: US 11,107,331 B2
(45) **Date of Patent: *Aug. 31, 2021**

(54) WAGERING GAME HAVING REELS WITH DYNAMIC GROWING-SYMBOL FEATURE

(71) Applicant: SG Gaming, Inc., Las Vegas, NV (US)

(72) Inventors: Dion K. Aoki, Chicago, IL (US); Allon G. Englman, Sanford, NC (US); Michael W. Mastropietro, River Forest, IL (US)

(73) Assignee: SG Gaming, Inc., Las Vegas, NV (US)

( * ) Notice: Subject to any disclaimer, the term of this patent is extended or adjusted under 35 U.S.C. 154(b) by 182 days.

This patent is subject to a terminal disclaimer.

(21) Appl. No.: 16/128,865

(22) Filed: Sep. 12, 2018

(65) Prior Publication Data

US 2019/0019377 A1 Jan. 17, 2019

Related U.S. Application Data

(63) Continuation of application No. 15/150,066, filed on May 9, 2016, now abandoned, which is a continuation of application No. 13/796,830, filed on Mar. 12, 2013, now Pat. No. 9,361,763.

(60) Provisional application No. 61/707,363, filed on Sep. 28, 2012.

(51) Int. Cl.
*G07F 17/34* (2006.01)
*G07F 17/32* (2006.01)

(52) U.S. Cl.
CPC ..... *G07F 17/34* (2013.01); *G07F 17/326* (2013.01); *G07F 17/3223* (2013.01)

(58) Field of Classification Search
CPC ..... G07F 17/32; G07F 17/34; G07F 17/326; G07F 17/3223; G07F 17/3213; G07F 17/3265
USPC ..... 463/16–20
See application file for complete search history.

(56) References Cited

U.S. PATENT DOCUMENTS

| | | | |
|---|---|---|---|
| 4,448,419 | A | 5/1984 | Teinaes |
| 5,152,529 | A | 10/1992 | Okada |
| 5,395,111 | A | 3/1995 | Inoue |
| 5,580,055 | A | 12/1996 | Hagiwara |
| 5,609,524 | A | 3/1997 | Inoue |
| 5,611,535 | A | 3/1997 | Tiberio |

(Continued)

FOREIGN PATENT DOCUMENTS

| | | |
|---|---|---|
| AU | 21918/88 | 4/1989 |
| AU | 2002301067 | 6/2003 |

(Continued)

*Primary Examiner* — Jasson H Yoo

(57) ABSTRACT

A gaming system has a plurality of reels. Each reel has a plurality of symbol locations. The gaming system is in communication with one or more processors. The gaming system involves the selection of a symbol location on a first reel of the plurality of reels. The selected symbol location is associated with a first type of symbol. At least one additional symbol location is added to the first reel at a location adjacent to the selected symbol location. Each additional symbol location is filled with the first type of symbol to create a first clump of the first type of symbols. Alternatively, the gaming system determines a number of additional symbol locations that are added to the first reel adjacent to the selected first symbol location. The gaming system then fills the additional symbol locations with symbols.

20 Claims, 8 Drawing Sheets

(56) References Cited

U.S. PATENT DOCUMENTS

| | | | |
|---|---|---|---|
| 5,624,119 | A | 4/1997 | Leake |
| 5,722,891 | A | 3/1998 | Inoue |
| 5,752,881 | A | 5/1998 | Inoue |
| 5,807,172 | A | 9/1998 | Piechowiak |
| 5,976,016 | A | 11/1999 | Moody et al. |
| 5,984,781 | A | 11/1999 | Sunaga |
| 6,007,066 | A | 12/1999 | Moody |
| 6,056,642 | A | 5/2000 | Bennett |
| 6,159,096 | A | 12/2000 | Yoseloff |
| 6,190,254 | B1 | 2/2001 | Bennett |
| 6,227,971 | B1 | 5/2001 | Weiss |
| 6,241,607 | B1 | 6/2001 | Payne et al. |
| 6,280,328 | B1 | 8/2001 | Holch |
| 6,309,299 | B1 | 10/2001 | Weiss |
| 6,319,124 | B1 | 11/2001 | Baerlocher et al. |
| 6,394,902 | B1 | 5/2002 | Glavich et al. |
| 6,439,993 | B1 | 8/2002 | O'Halloran |
| 6,464,581 | B1 | 10/2002 | Yoseloff et al. |
| 6,517,432 | B1 | 2/2003 | Jaffe |
| 6,517,433 | B2 | 2/2003 | Loose et al. |
| 6,544,120 | B2 | 4/2003 | Ainsworth |
| 6,604,999 | B2 | 8/2003 | Ainsworth |
| 6,644,664 | B2 | 11/2003 | Muir et al. |
| 6,663,487 | B1 | 12/2003 | Ladner |
| 6,676,512 | B2 | 1/2004 | Fong et al. |
| 6,695,696 | B1 | 2/2004 | Kaminkow |
| 6,726,204 | B2 | 4/2004 | Inoue |
| 6,805,349 | B2 | 10/2004 | Baerlocher et al. |
| 6,869,357 | B2 | 3/2005 | Adams et al. |
| 6,880,826 | B2 | 4/2005 | Inoue |
| 6,893,018 | B2 | 5/2005 | Inoue |
| 6,896,615 | B2 | 5/2005 | Berman |
| 6,905,408 | B2 | 6/2005 | Inoue |
| 6,908,381 | B2 | 6/2005 | Ellis |
| 6,910,962 | B2 | 6/2005 | Marks et al. |
| 6,932,700 | B2 | 8/2005 | Bennett et al. |
| 6,960,134 | B2 | 11/2005 | Hartl et al. |
| 7,029,396 | B2 | 4/2006 | Jaffe et al. |
| 7,056,213 | B2 | 6/2006 | Ching et al. |
| 7,179,166 | B1 | 2/2007 | Abbott |
| 7,214,132 | B2 | 5/2007 | Inoue |
| 7,237,775 | B2 | 7/2007 | Thomas et al. |
| 7,252,589 | B1 | 8/2007 | Marks et al. |
| 7,252,591 | B2 | 8/2007 | Van Asdale |
| 7,311,602 | B2 | 12/2007 | Inoue |
| 7,316,395 | B1 | 1/2008 | Kromydas |
| 7,351,144 | B2 | 4/2008 | Daly |
| 7,479,061 | B2 | 1/2009 | Okada |
| 7,690,984 | B2 | 4/2010 | Tran et al. |
| 7,753,773 | B2 * | 7/2010 | Baerlocher ..... G07F 17/32 463/20 |
| 8,096,869 | B2 | 1/2012 | Yoshimi |
| 8,235,796 | B2 | 8/2012 | Nakamura |
| 8,366,540 | B2 | 2/2013 | Yoshimi |
| 2002/0039920 | A1 | 4/2002 | Bryant |
| 2002/0123378 | A1 | 9/2002 | Bucknall et al. |
| 2003/0013517 | A1 | 1/2003 | Bennett et al. |
| 2003/0027611 | A1 | 2/2003 | Recard |
| 2003/0045354 | A1 | 3/2003 | Giobbi |
| 2003/0087687 | A1 | 5/2003 | Locke et al. |
| 2003/0134673 | A1 | 7/2003 | Moody |
| 2004/0012145 | A1 | 1/2004 | Inoue |
| 2004/0014516 | A1 | 1/2004 | Inoue |
| 2004/0014517 | A1 | 1/2004 | Inoue |
| 2004/0017041 | A1 | 1/2004 | Inoue |
| 2004/0026854 | A1 | 2/2004 | Inoue |
| 2004/0036218 | A1 | 2/2004 | Inoue |
| 2004/0038726 | A1 | 2/2004 | Inoue |
| 2004/0048646 | A1 | 3/2004 | Visocnik |
| 2004/0053679 | A1 | 3/2004 | Getz et al. |
| 2004/0058727 | A1 | 3/2004 | Marks et al. |
| 2004/0063488 | A1 | 4/2004 | Berman |
| 2004/0072610 | A1 | 4/2004 | White et al. |
| 2004/0116175 | A1 | 6/2004 | Aida |
| 2004/0198486 | A1 | 10/2004 | Walker et al. |
| 2004/0219969 | A1 | 11/2004 | Casey et al. |
| 2004/0266520 | A1 | 12/2004 | Aida |
| 2005/0043083 | A1 | 2/2005 | Inoue |
| 2005/0043084 | A1 | 2/2005 | Inoue |
| 2005/0159208 | A1 | 7/2005 | Pacey |
| 2005/0277460 | A1 | 12/2005 | Inoue |
| 2005/0288087 | A1 * | 12/2005 | Meyer ..... G07F 17/3244 463/13 |
| 2006/0046830 | A1 | 3/2006 | Webb |
| 2006/0052155 | A1 | 3/2006 | Inoue |
| 2006/0084492 | A1 | 4/2006 | Baerlocher et al. |
| 2006/0084498 | A1 | 4/2006 | Baerlocher et al. |
| 2006/0166731 | A1 | 7/2006 | Yoshimi et al. |
| 2006/0183533 | A1 | 8/2006 | Tran et al. |
| 2006/0183534 | A1 | 8/2006 | Yoshimi |
| 2006/0247002 | A1 | 11/2006 | Yoshimi et al. |
| 2006/0287060 | A1 | 12/2006 | Yoshimi |
| 2007/0010308 | A1 | 1/2007 | Duhamel |
| 2007/0015565 | A1 | 1/2007 | Chan |
| 2007/0270203 | A1 | 11/2007 | Aida |
| 2008/0045300 | A1 | 2/2008 | Quayle et al. |
| 2008/0045323 | A1 | 2/2008 | Berman |
| 2009/0082087 | A1 | 3/2009 | Pacey et al. |
| 2009/0227332 | A1 | 9/2009 | Yoshizawa |
| 2010/0210343 | A1 | 8/2010 | Englman |
| 2011/0105218 | A1 | 5/2011 | Anderson |
| 2011/0201406 | A1 | 8/2011 | Jaffe |
| 2012/0115570 | A1 | 5/2012 | Collette |

FOREIGN PATENT DOCUMENTS

| | | |
|---|---|---|
| AU | 768153 | 12/2003 |
| AU | 2004200033 | 7/2004 |
| AU | 2004203045 | 7/2004 |
| AU | 2007254668 | 1/2008 |
| AU | 2010202101 | 6/2010 |
| GB | 2097160 | 10/1982 |
| GB | 2117952 | 10/1983 |
| JP | H06-246043 | 9/1994 |
| JP | 2002-325881 | 11/2002 |
| JP | 2003-236055 | 8/2003 |
| WO | WO 2007/089410 | 8/2007 |

* cited by examiner

270
H1
L2
L4
M1
L3
L1
M2
M3
W
H1
L2
L4
M1
L3
L1
M2
M3
W
H1
L2
L4
M1
L3
L1
M2
B
L2
M2
274
272
282
270a
H1
L2
L4
M1
L3
L1
M2
M3
W
W
W
W
H1
L2
L4
M1
L3
L1
M2
M2
M2
M2
B
L2
M2
276a
278a
274
272
286a
288a
284
282
270b
H1
L2
L4
M1
L3
L1
M2
M3
W
W
W
W
H1
L2
L4
M1
L3
L1
M2
M2
M2
M2
B
L2
M2
274
272
278b
276b
284
282
288b
286b
370
H1
L2
L4
M1
L3
L1
M2
M3
W
H1
L2
L4
M1
L3
L1
M2
B
L2
M2
373
370a
H1
L2
L4
M1
L3
L1
M2
M3
W
H1
L2
L4
M1
L3
L1
H1
L2
L4
M1
L3
L1
M2
B
L2
M2
375a
373
370b
H1
L2
L4
M1
L3
L1
M2
M3
W
H1
L2
L4
M1
L3
L1
H1
L2
L4
M1
L3
L1
M2
B
L2
M2
373
375b

WAGERING GAME HAVING REELS WITH DYNAMIC GROWING-SYMBOL FEATURE

CROSS-REFERENCE AND CLAIM OF PRIORITY TO RELATED APPLICATION

This application is a continuation of U.S. patent application Ser. No. 15/150,066, filed May 9, 2016 and titled "Wagering Game Having Reels With Dynamic Growing-Symbol Feature," which is a continuation of U.S. patent application Ser. No. 13/796,830, filed Mar. 12, 2013 (now U.S. Pat. No. 9,361,763, issued on Jun. 7, 2016) and titled "Wagering Game Having Reels With Dynamic Growing-Symbol Feature," which claims the benefit of and priority to U.S. Provisional Patent Application No. 61/707,363, which was filed on Sep. 28, 2012, and titled "Wagering Game Having Reels With Dynamic Growing-Symbol Feature," all of which are incorporated herein by reference in their entirety.

COPYRIGHT

A portion of the disclosure of this patent document contains material which is subject to copyright protection. The copyright owner has no objection to the facsimile reproduction by anyone of the patent disclosure as it appears in the U.S. Patent and Trademark Office patent files or records, but otherwise reserves all copyright rights whatsoever.

TECHNICAL FIELD

The present disclosure relates generally to wagering games, as well as wagering game terminals and wagering game systems. More particularly, the present disclosure relates to systems, methods, and devices for altering one or more of the plurality of reels of the wagering game.

BACKGROUND

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One way that players may experience a heightened entertainment level while playing the wagering game is when the player senses that he or she has a better chance of achieving a winning outcome. Because the player is typically focused on the display on which the wagering game is being played, providing visual indicators that a winning outcome player is more likely to be achieved in the wagering game can be influential in attracting new players and maintaining existing players. The present invention is directed to providing a specific type of visual indicator on the reels of a slots-based wagering game.

SUMMARY

One aspect of the present invention relates to a method of operating a gaming system that is in communication with one or more processors. The gaming system has a plurality of reels and each of the plurality of reels has a plurality of symbol locations. The method comprises selecting, via at least one of the one or more processors, a symbol location on a first reel of the plurality of reels, and determining, via at least one of the one or more processors, a number of additional symbol locations to be added to the first reel. The additional symbol locations are to be adjacent to the selected symbol location. The method further includes adding, via at least one of the one or more processors, the determined number of additional symbol locations to the first reel, and filling the additional symbol locations with symbols.

In accordance with another aspect, the present invention is a gaming system for playing a wagering game having a plurality of reels. Each of the reels has a plurality of symbol locations. The gaming system comprising one or more display devices, one or more processors, and one or more memory devices storing instructions that, when executed by at least one of the one or more processors, cause the gaming system to (i) select a first symbol location on a first reel of the plurality of reels, (ii) determine a number of additional symbol locations to be added to the first reel such that one of the additional symbol locations is adjacent to the selected first symbol location, (iii) add the determined number of additional symbol locations to the first reel, and (iv) fill the additional symbol locations with symbols.

In yet another aspect, the present invention is a method of operating a gaming system having a plurality of reels and each of the reels has a plurality of symbol locations. The gaming system is in communication with one or more processors. The method comprises selecting, via at least one of the one or more processors, a symbol location on a first reel of the plurality of reels. The selected symbol location is associated with a first type of symbol. The method further includes adding, via at least one of the one or more processors, at least one additional symbol location to the first reel at a location adjacent to the selected symbol location, and filling, via at least one of the one or more processors, each additional symbol location with the first type of symbol to create a clump of the first type of symbols.

In accordance with yet another aspect, the invention is a gaming system for playing a wagering game having a plurality of reels and each of the reels has a plurality of symbol locations. The gaming system comprises one or more display devices and one or more processors. The gaming system also includes one or more memory devices storing instructions that, when executed by at least one of the one or more processors, cause the gaming system to (i) select a symbol location on a first reel of the plurality of reels that is associated with a first type of symbol, (ii) add at least one additional symbol location to the first reel at a location adjacent to the selected symbol location, and (iii) fill each additional symbol location with the first type of symbol to create a clump of the first type of symbols.

In yet another aspect, the present invention is a method of operating a gaming system having a plurality of reels. Each of the reels has a plurality of symbol locations. The gaming system is in communication with one or more processors. The method comprises selecting, via at least one of the one or more processors, a symbol location on a first reel of the plurality of reels. The selected symbol location is associated with a first type of symbol. The method further includes moving, via at least one of the one or more processors, a variable symbol group from a first segment of the first reel to a location adjacent to the selected symbol location. The number of symbol locations on the first reel remains constant before and after the moving. The method also includes filling, via at least one of the one or more processors, each symbol location within the variable symbol group with the first type of symbol to create a first clump of the first type of symbols.

Other aspects of the invention include physical machine-readable storage media including instructions which, when executed by one or more processors resident to a gaming machine, cause the one or more processors to perform operations and methods of the gaming system that are set forth above.

The above summary is not intended to represent each embodiment or every aspect of the present disclosure. Rather, the summary merely provides an exemplification of some of the novel features presented herein. The above features and advantages, and other features and advantages of the present disclosure, will be readily apparent from the following detailed description of exemplary embodiments and best modes for carrying out the present invention when taken in connection with the accompanying drawings and the appended claims.

Figure 1:
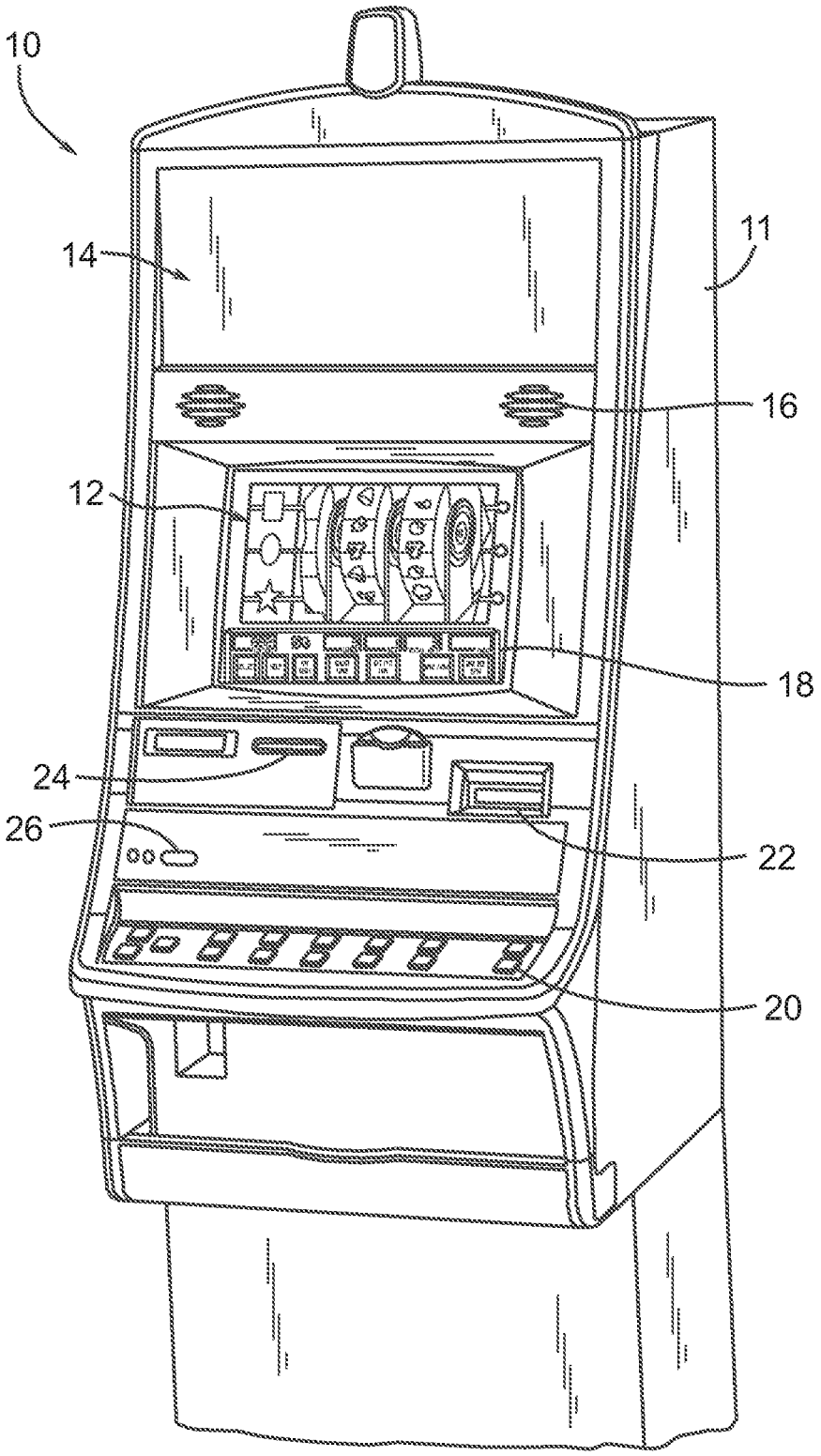
FIG. 1 (PRIOR ART)
FIG. 1 is a perspective-view illustration of an exemplary free-standing gaming terminal according to aspects of the present disclosure.

While aspects of this disclosure are susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may involve wagers of real money, as found with typical land-based or on-line casino games. In other embodiments, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433, titled "Reel Spinning Slot Machine With Superimposed Video Image," U.S. Patent Application Publication Nos. US2010/0069160, titled "Handheld Wagering Game Machine And Docking Unit," and US2010/0234099, titled "Wagering Game System With Docking Stations" which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
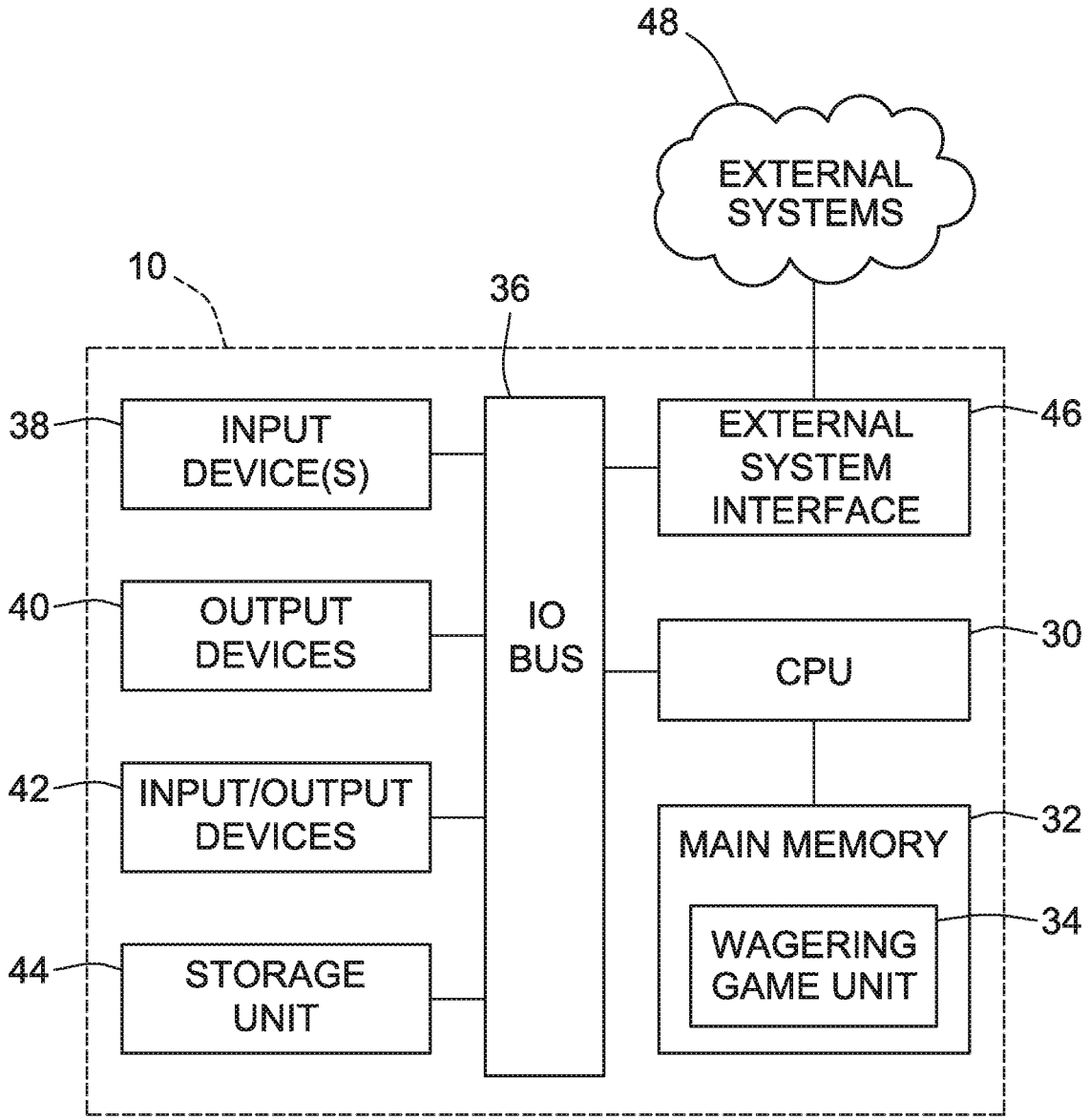
FIG. 2 (PRIOR ART)
FIG. 2 is a schematic diagram of an example of a gaming system according to aspects of the present disclosure.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video blackjack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
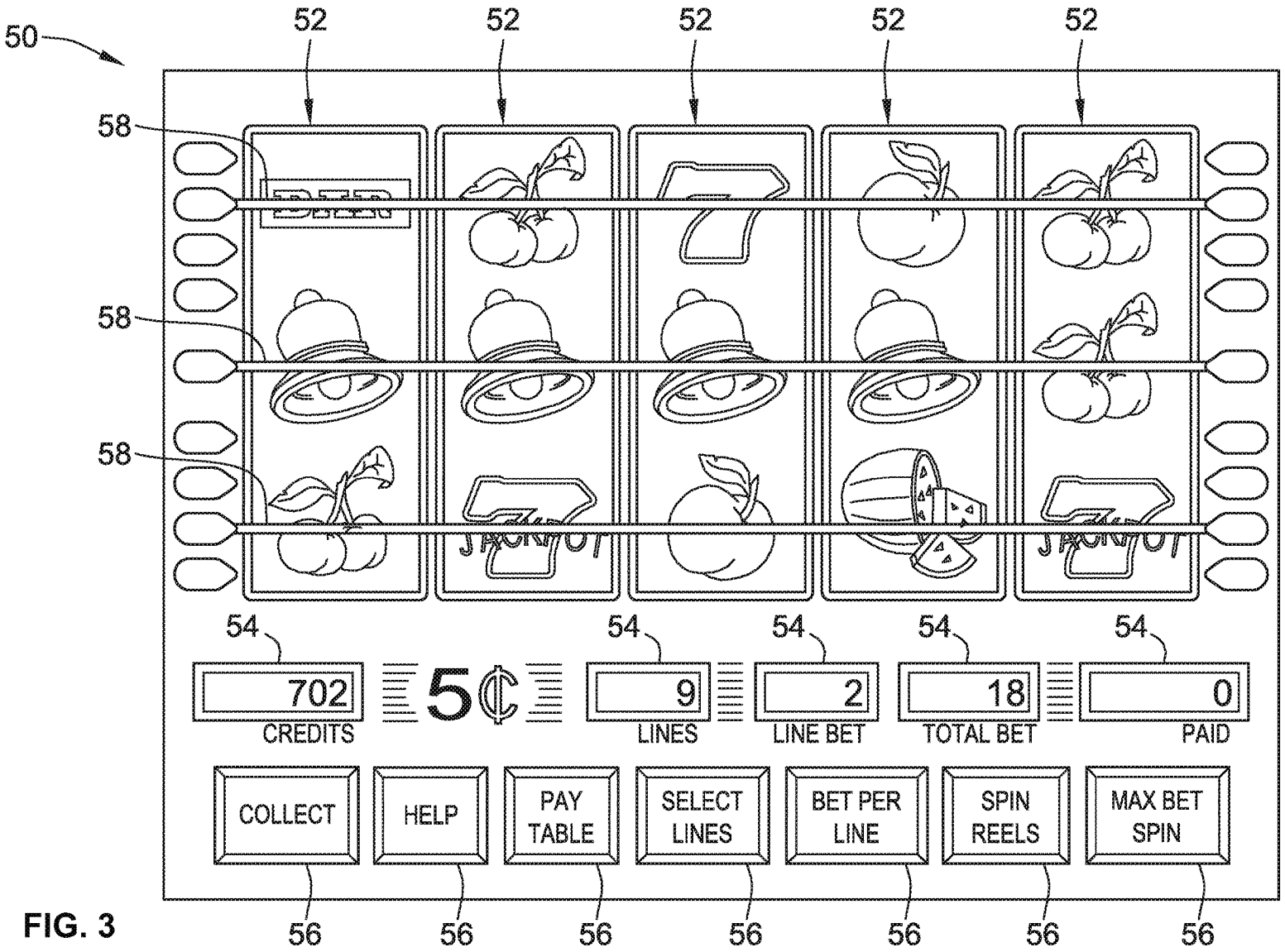
FIG. 3 (PRIOR ART)
FIG. 3 is a screen shot of a representative basic-game screen of a wagering game displayed on a gaming terminal, gaming device, and/or gaming system according to aspects of the present disclosure.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving an input indicative of a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figures 4A, 4B, 4C, 5A, 5B, 5C:
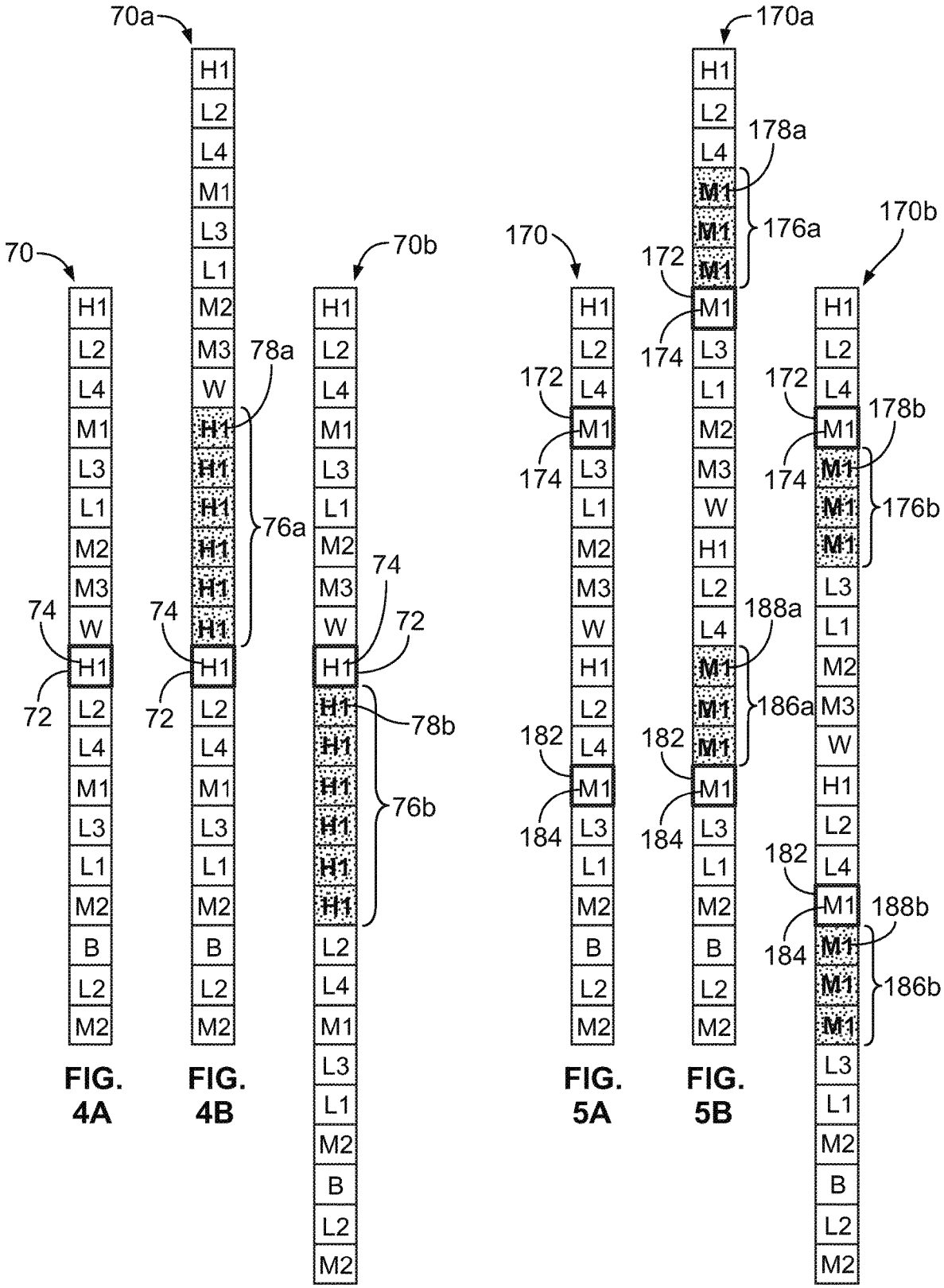
FIGS. 4A-4C set forth a first diagrammatic illustration of the altering of one of the plurality of reels in the wagering game.
FIGS. 5A-5C set forth a second diagrammatic illustration of the altering of one of the plurality of reels in the wagering game.

FIG. 4A provides a diagrammatic illustration of a reel strip 70 that would correspond to one of the reels 52 in FIG. 3. The reel strip 70 contains nineteen (19) symbol locations and each symbol location is associated with a certain symbol. For simplicity in these diagrammatic illustrations, the symbols are show as alphanumeric symbols (e.g., H1, L2, L4, M1, etc), which would correspond to the "bell" symbols, the "cherry" symbols, the "7" symbols, etc. in FIG. 3. In FIG. 4A, a symbol location 72 with an "H1" symbol 74 has been selected. The symbol location 72 and the "H1" symbol 74 will affect the manner in which the reel strip 70 is "grown" or expanded, as discussed below relative to FIGS. 4A and 4B.

In FIG. 4B, the reel strip 70 of FIG. 4A has been altered by expansion to create a modified reel strip 70*a*. The modified reel strip 70*a* includes six additional symbol locations 76*a* directly above the selected symbol location 72 having the "H1" symbol 74. Each of the six additional symbol locations 76*a* is filled with another "H1" symbol 78*a*. By doing so, the modified reel strip 70*a* includes a "clump" of seven "H1" symbols. As used herein, the term "clump" or "symbol clump" refers to the same symbol occupying two or more symbol locations that are located immediately adjacent to one another on a single reel strip. In an alternative configuration, a clump may comprise a single, elongated or enlarged symbol (not shown) that occupies two or more adjacent symbol positions on a single reel. In yet a further alternate arrangement, a clump may comprise one or more elongated symbols, alone or in combination with one or more standard-sized symbols that occupy numerous symbol positions that are all immediately adjacent one another on a single reel.

By creating a clump of symbols in the reel strip 70, the rotation of the reel strip 70 through the display region causes the player to experience a heightened level of entertainment and excitement because the player senses that he or she has a better chance of achieving a winning outcome. This is especially true if the reel strip 70 is the leftmost reel of the plurality of reels and the "H1" symbol 74 is a symbol that starts several beneficial winning outcomes when using a left-to-right evaluation scheme. Additionally, the wagering game may have several reels that undergo the same six-symbol "growth" (or an enlargement greater than or less than six symbol locations) in their reel strip length that causes several symbol clumps of "H1" symbols on different reels. Accordingly, if the first two or three reels (from left to right) have symbol clumps with the same symbol (e.g., the "H1" symbol), then there is a more heightened sense of anticipation for the player because he or she can see the movement of these multiple clumps through the display region as the reels move, leading to the belief that several winning combinations are possible across the paylines 58 (FIG. 3).

In FIG. 4A, a random number generator (usually involving one or more of the processors in the gaming system, such as CPU 30 in FIG. 2) is used to select the symbol location 72 from the nineteen symbol locations on the reel strip 70. Once the symbol location 72 has been selected, one or more of the processors (such as CPU 30 in FIG. 2) within the gaming system determines the number of additional symbol locations and fills those additional symbol locations 76*a* with the identical symbol to create the enlarged reel strip 70*a* having the clump of symbols. The number of additional symbol locations will typically range from one symbol location to perhaps eight, ten, twenty, or even a thousand symbol locations. The number of additional symbol locations can be selected based on a weighted table. Alternatively, the number of additional symbol locations does not need to be selected, but is a fixed number of symbols having a predetermined length.

In a further alternative, the symbol(s) on the five reels to be expanded is displayed to the player on a separate secondary reel. The secondary reel would typically spin before or during the movement of the five primary reels and the symbol selected by the secondary reel would cause some or all of the like symbols on the five primary reels to expand. Of course, additional spins of the secondary reel could occur during a single play to select multiple symbols to be expanded on the five primary reels. Or, multiple secondary reels could be used to indicate multiple symbols to be expanded on the five primary reels. In a different alternative, a clump of symbols having a certain size on the first reel may cause a snowball effect, whereby like symbols on the remaining reels expand as well. This latter alternative would be very beneficial to the player as the same symbol could be expanded numerous times across the reels. Of course, video effects could be used to allow the player to visualize the various expansions as they spread from reel to reel.

The random selection process may involve a selection on each of the reels in the wagering game. Thus, a single symbol location on five different reels may be randomly selected for expansion (i.e., five symbol locations, each of which is on a different reel). The symbols within the symbol locations that trigger expansion could be the same, or may be entirely different symbols.

Alternatively, a table may dictate which symbol type is selected for expansion on each of the five reels. For example, the following table illustrates various possible Options 1 to "n" that can be randomly selected so as to dictate which symbol on which reel will be expanded.

| Option | Reel 1 | Reel 2 | Reel 3 | Reel 4 | Reel 5 |
|---|---|---|---|---|---|
| 1 | M1 | L2 | L2 | M1 | L2 |
| 2 | M1 | M1 | None | M1 | None |
| 3 | L3 | L2 | L3 | L2 | L3 |
| 4 | H1 | None | None | None | None |
| 5 | H1 | H1 | H1 | None | None |
| 6 | M2 | M2 | M2 | M2 | M2 |
| . . . | . . . | . . . | . . . | . . . | . . . |
| "n" | M3 | M3 | None | None | None |

Thus, if Option 5 is selected, an "H1" symbol on each of the three first reels will be expanded, but no symbols will be expanded on fourth and fifth reel. Exactly which "H1" symbol on each reel that will be expanded may involve a second random selection. Or, the table could specify the exact "H1" symbol will be the basis for expansion (e.g., by identifying symbol locations, and not just symbols). Further, the Options within the table can themselves be weighted, such that an Option with a very positive expansion (the same symbol is expanded multiple times on each of the five reels) is less likely to occur than other Options.

In FIG. 4C, a modified reel strip 70*b* includes six additional symbol locations 76*b* that are filled with six "H1" symbols 78*b*. The primary difference between FIG. 4C and FIG. 4B is that the additional symbol locations 76*b* are located below the selected symbol location 72 in FIG. 4C, whereas the additional symbol locations 76*a* are located above the selected symbol location 72 in FIG. 4B. Locating the symbol clump above the selected symbol location 72 (FIG. 4B) may be preferable if the growth occurs while the reel is spinning. This is due to the fact that the movement of the reel strip 70*a* is downwardly and it may easier to have the symbol locations added behind the selected symbol location 72 just before it enters into the symbol array that is within the player's view. In that way, the player does not actually visualize the expansion of the reel 70 into the display region, but simply sees the additional identical symbols trailing the selected symbol location 72.

FIG. 5A illustrates a different diagrammatic illustration of a reel strip 170 that would correspond to one of the reels 52 in FIG. 3. The reel strip 170 contains nineteen (19) symbol locations and each symbol location is associated with a certain symbol. In FIG. 5A, a first symbol location 172 with an "M1" symbol 174 has been selected in a manner similar to what has been set forth in FIG. 4. Additionally, a second symbol location 182 with another "M1" symbol 184 has been selected. Like FIG. 4, the first and second selected symbol locations 172 and 182 with the "M1" symbols 174 and 184, respectively, will affect the manner in which the reel strip 170 is "grown" or expanded, as discussed below relative to FIGS. 5A and 5B.

In FIG. 5B, the reel strip 170 has been altered to create a reel strip 170*a*. The reel strip 170*a* has grown by adding a first set of additional symbol locations 176*a* above the first selected symbol location 172 and a second set of additional symbol locations 186*a* above the second selected symbol location 182. Each of the first set of additional symbol locations 176*a* is filled with "M1" symbols 178*a*. The symbol locations within the second set of additional symbol locations 186*a* are filled with "M1" symbols 188*a*. The result is that the altered reel strip 170*a* includes two different symbol clumps, each of which has four adjacent "M1" symbols. The multiple clumps of identical symbols in the reel strip 170*a* causes the player to experience a heightened level of entertainment and excitement, as he or she senses that there is a better chance of achieving a winning outcome.

FIG. 5C illustrates an alternative embodiment in which the reel strip 170 of FIG. 5A is grown by adding a first set of additional symbol locations 176*b* and a second set of additional symbol locations 186*b*. An "M1" symbol 178*b* is used to fill each of the first set of additional symbol locations 176*b*. Likewise, an "M1" symbol 188*b* is used to fill the second set of additional symbol locations 186*b*. The primary difference between FIGS. 5B and 5C is that the first set of additional symbol locations 176*b* and the second set of additional symbol locations 186*b* are added below the first selected symbol location 172 and second selected symbol location 182, respectively. It should be noted that FIGS. 5B and 5C also illustrate an embodiment in which all of the possible like symbols on the reel strip 170 (i.e., all "M1" symbols) are expanded.

In the embodiments of FIGS. 5A-5C, the two (or more) symbols locations 172 and 182 having like symbols that will trigger the adjacent additional symbol locations can be randomly selected. Additionally, the number of additional symbol locations to be added to the reel strip can be determined based on a random selection as well. Further, the symbol locations across all reels on which the additional symbol locations may be added can be randomly determined. For example, if there are 15 total "M1" symbols on the five reels, the gaming system may randomly select five of the 15 total "M1" symbols for expansion. Or, the random selection process may provide weighting to the "M1" symbols on the leftmost reels so as to provide a higher probability that the "M1" symbols to the left of the center reel are more likely to receive symbol clumps. That way, in the typical left-to-right evaluation scheme, there is more of a chance of a winning symbol combination involving the symbol clumps on the two leftmost reels. And, the various types of random selections set forth above in FIG. 4 to determine the symbol location(s), the reel(s), and the size(s) of each expansion can be also used in the alternative of FIG. 5.

Figures 6A, 6B, 6C, 7A, 7B, 7C:
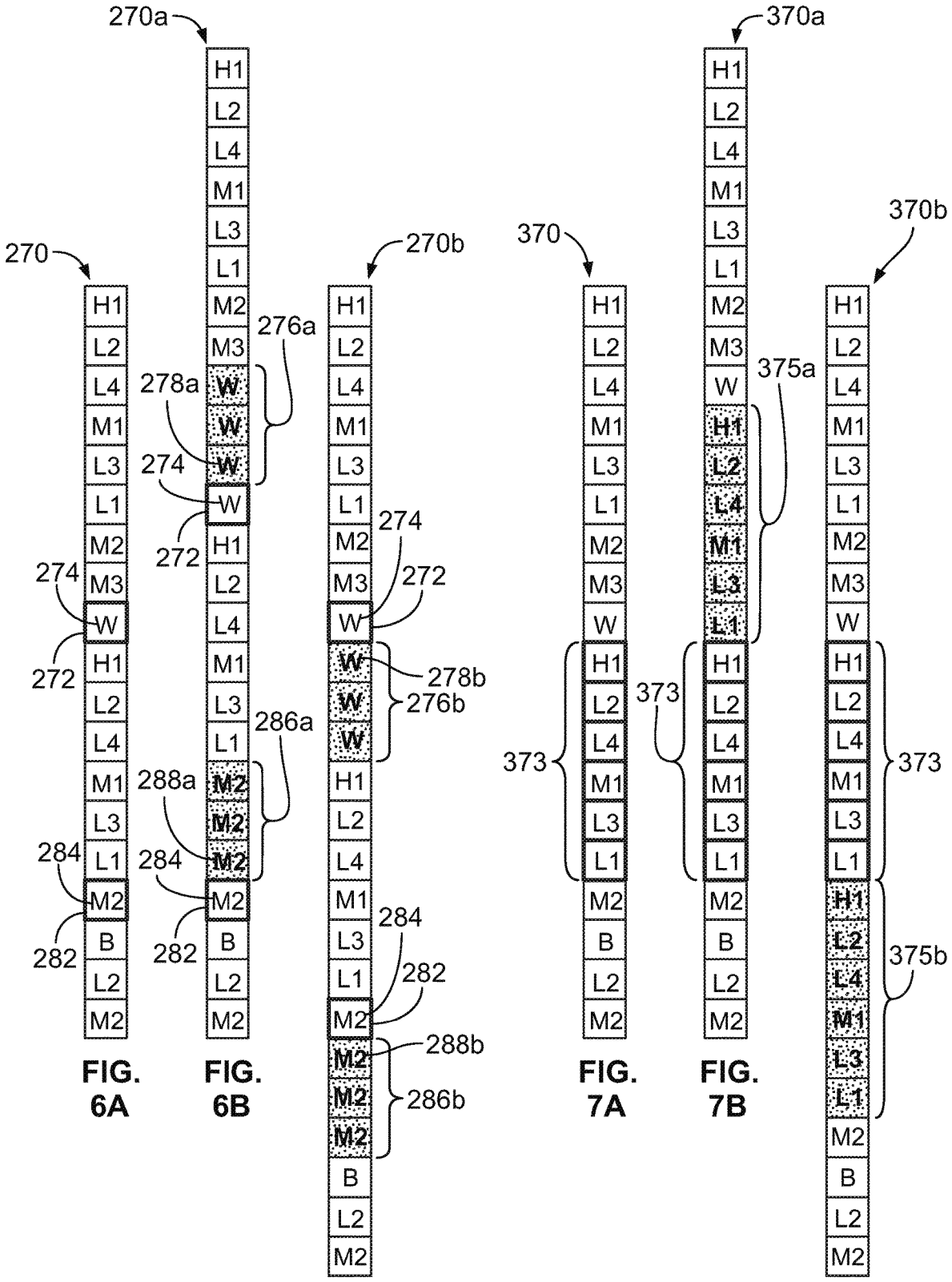
FIGS. 6A-6C set forth a third diagrammatic illustration of the altering of one of the plurality of reels in the wagering game.
FIGS. 7A-7C set forth a fourth diagrammatic illustration of the altering of one of the plurality of reels in the wagering game.

FIG. 6A illustrates a different diagrammatic illustration of a reel strip 270 that would correspond to one of the reels 52 in FIG. 3. The reel strip 270 contains nineteen (19) symbol locations and each symbol location is associated with a certain symbol. In FIG. 6A, a first symbol location 272 with a "W" symbol 274 (i.e., a "Wild" symbol) has been selected for expansion. Additionally, a second symbol location 282 with a different symbol, a "M2" symbol 284, has also been selected. The first and second selected symbol locations 272 and 282 with the "W" symbol 274 and the "M2" symbol 284, respectively, will affect the manner in which the reel strip 270 is expanded.

The reel strip 270 in FIG. 6A has been expanded in FIG. 6B to create the modified reel strip 270*a*, which has added a first set of additional symbol locations 276*a* above the first selected symbol location 272 and a second set of additional symbol locations 286*a* above the second selected symbol location 282. Each of the first set of additional symbol locations 276*a* is filled with "W" symbols 278*a*. The symbol locations within the second set of additional symbol locations 286*a* are filled with "M2" symbols 288*a*. As such, the reel strip 270*a* includes two different symbol clumps. But, unlike FIGS. 4 and 5, each symbol clump in FIG. 6B involves a different symbol.

FIG. 6C is similar to FIG. 6B except that a first set of additional symbol locations 276*b* and a second set of additional symbol locations 286*b* are located below the first and second symbol locations 272, 282, respectively. Each of the first set of additional symbol locations 276*b* is filled with "W" symbols 278*b*. Each of the second set of additional symbol locations 286*b* is filled with "M2" symbols 288*b*. The various types of random selections to determine the symbol location(s), the reel(s), and the size(s) of each expansion that are discussed above with regard to FIGS. 4 and 5 can be used in FIG. 6 as well. In addition, it should be noted that the random selection may be of a particular symbol (e.g., M2) and the reels may expand at each symbol location that contains the selected symbol. As in the above-described embodiments, the size of each expansion may be of a predetermined length or of various lengths that are determined from prior and/or supplemental random selection(s).

FIGS. 7A-7C illustrate a different alternative in which a reel 370 has a symbol-location group 373 that serves as a triggering mechanism for altering the reel. As can be seen in FIG. 7B, the symbol-location group 373 has six symbol locations and six additional symbol locations 375*a* are added directly above the symbol-location group 373. The six additional symbol locations 375*a* are then filled with the same set of symbols as the symbol-location group 373. In FIG. 7C, a set of six additional symbol locations 375*b* are added below (not above) the symbol-location group 373 and are then filled with the same set of symbols as the symbol-location group. In should be noted that in the embodiment of FIG. 7, a smaller triggering symbol location group can be used (e.g., two symbol locations) and the two symbols can be replicated multiple times in four or six new symbol locations located above or below the triggering group. Such an embodiment would create an expansion with additional symbol locations having a repeating symbol pattern (e.g., an "H1" symbol, an "M1" symbol, an "H1" symbol, an "M1" symbol, etc.)

In each of the embodiments of FIGS. 4-7, the triggering symbol location (or symbol-location group) determines the symbols used to fill the new additional symbol locations. However, the additional symbol locations could also be randomly filled. While this may not lead to the symbol clumping, the symbols used to fill the additional symbol locations could be other types of beneficial symbols, such as wild symbols, scatter payout symbols, progressive game symbols, etc.) Or, the random selection could result in the addition of a combination of beneficial symbols and symbols identical to the symbol within the triggering symbol location.

Figure 8:
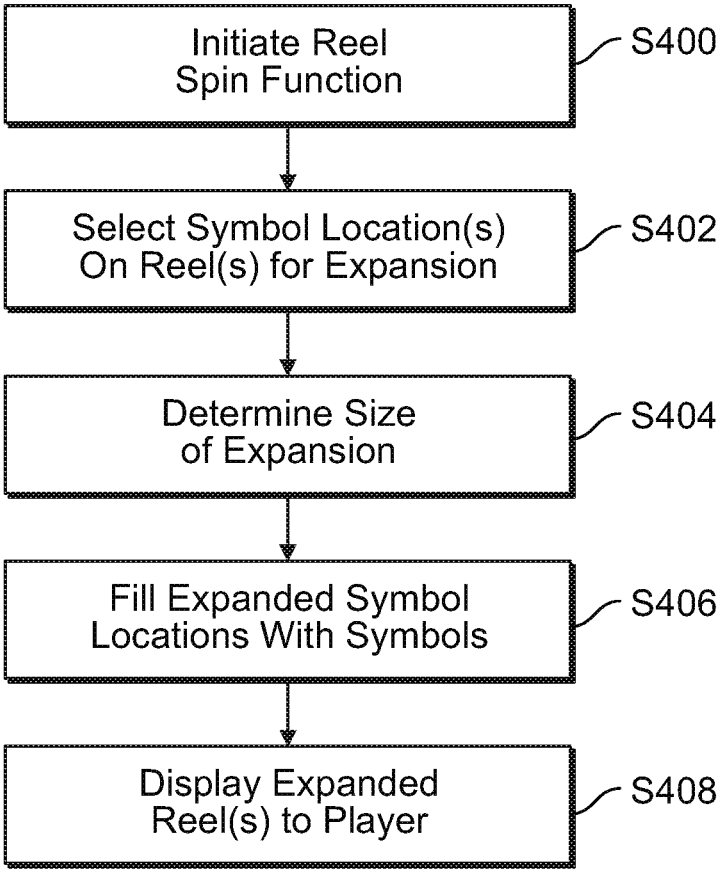
FIG. 8 is a flowchart for an exemplary method or algorithm that can correspond to instructions that can be stored on one or more non-transitory computer-readable media and can be executed by one or more controllers in accord with aspects of the disclosed concepts.

FIG. 8 illustrates one algorithm that could be used to implement the aforementioned processes within a gaming system. At step S400, the reel spin function is initiated. Just prior to the reels spinning or while the reels have begun to spin, at step S402, a symbol location(s) is selected on one or more of the reels for expansion. The size of the expansion is then determined at step S404, and the affected reels are then enlarged by the determined number of additional symbol locations. As discussed above, the size may also be fixed, such that no determination is needed fro the size of the expansion.

At step S406, the additional symbol locations are then filled with new symbols. The added symbols are typical determined by symbol(s) within the selected symbol location(s) from step S402. Or, the symbols can be randomly filled into the additional symbol locations, such as beneficial symbols (e.g., "Wild" symbols). Finally, the newly expanded reel(s) is displayed in a manner such that player recognizes that new symbols have been added.

Figures 9A, 9B, 9C, 9D, 9E:
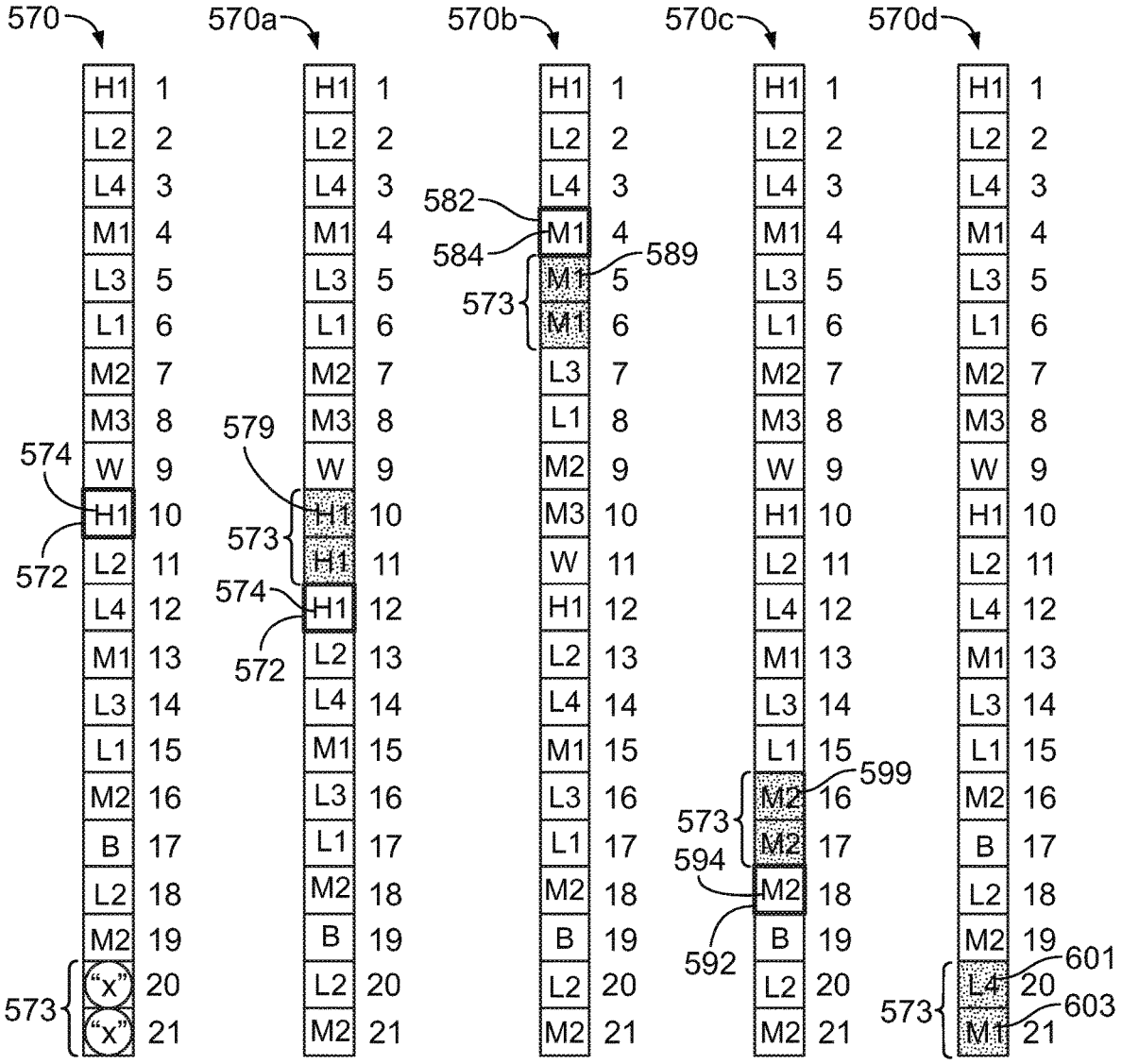
FIGS. 9A-9E set forth a fifth diagrammatic illustration of the altering of one of the plurality of reels in the wagering game.

FIGS. 9A-9E illustrate an alternative embodiment in which a reel 570 has a fixed number of symbol locations (twenty-one symbol locations in this case, although any fixed number of symbol locations is possible as well). Referring initially to FIG. 9A, like the previous embodiments, a symbol location 572 on the reel 570 may be selected so as to permit the creation of a symbol clump, which will include the "H1" symbol 574. Unlike the previous embodiments, however, the reel 570 includes a variable symbol grouping 573. The variable symbol grouping 573 includes a fixed number of symbol locations on the reel 570 and is movable (or transferable) to other segments of the reel 570. In the embodiment of FIG. 9, the variable symbol grouping 573 includes two symbol locations, which are initially at symbol locations #20 and #21. The variable symbol grouping 573 can include any type of symbol on any given spin (shown as the variable "x" in FIG. 9A), which makes it possible to create a symbol clump on the reel 570.

As shown in FIG. 9B, the variable symbol grouping 573 has been moved from symbol locations #20 and #21 to symbol locations #10 and #11, which are directly above the selected symbol location 572. Additionally, the variable symbol grouping 573 includes an added "H1" symbol 579 at both symbol locations. Due to the movement of the variable symbol grouping 573 and the filling of the variable symbol grouping 573 with the added "H1" symbols 579, a three-symbol clump of "H1" symbols has now been formed on the altered reel 570*a*. After undergoing this alteration, the altered reel 570*a* still includes only twenty-one symbol locations because the symbols associated with the selected symbol location 572 and the symbol locations directly below selected symbol location 572 have been shifted downwardly by two symbol locations. For example, the "L2" symbol at symbol location #11 in FIG. 9A is now at symbol location #13 in FIG. 9B, and the "M2" symbol at symbol location #19 in FIG. 9A is now at symbol location #21 in FIG. 9B.

FIG. 9C illustrates another movement of the variable symbol grouping 573 on the reel 570 in FIG. 9A that results in an altered reel 570*b* having a symbol clump. Specifically, a symbol location 582 having an "M1" symbol 584 is selected to create the symbol clump. The variable symbol grouping 573 is moved to symbol locations #5 and #6 directly below the symbol location 582. The variable symbol grouping 573 is then filled with an added "M1" symbol 589 to create a three-symbol clump of "M1" symbols on the altered reel 570*b*. It should be noted that, unlike the altered reel 570*a* in FIG. 9B, the altered reel 570*b* in FIG. 9C adds the "M1" symbols 589 below the selected symbol location 582.

FIG. 9D illustrates yet another movement of the variable symbol grouping 573 on the reel 570 in FIG. 9A that results in an altered reel 570*c* having a symbol clump. Here, a symbol location 592 having an "M2" symbol 594 has been selected to be a part of the symbol clump. The variable symbol grouping 573 is moved to symbol locations #16 and #17 directly above the selected symbol location 592. Each of the two symbol locations associated with the variable symbol grouping 573 is then filled with an added "M2" symbol 599.

FIG. 9E illustrates an embodiment in which the reel 570 of FIG. 9A lacks a symbol clump. Specifically, the variable symbol grouping 573 is maintained at symbol locations #20 and #21. Additionally, the two symbol locations associated with the variable symbol grouping 573 are filled with an "L4" symbol 601 and a "M1" symbol 603. The resultant reel 570*d* does not include a symbol clump at any location along its length. In this instance, the variable symbol grouping 573 is not moved to other symbol locations within the reel 570, but remains at the symbol locations #20 and #21. Additionally, it should be noted that symbols other than the "L4" symbol 601 and the "M1" symbol 603 can be used to fill the variable symbol grouping 573 so as to alter or maintain certain math models associated with the wagering game.

In summary, FIGS. 9A-9E illustrate how the single reel 570 can be altered to include a symbol clump during some spins (FIGS. 9B-9D), while not having a symbol clump in other spins (FIG. 9E). In other words, if viewed as a sequence of spins, the first three spins of the reel 570 would include three different types of three-symbol clumps (FIGS. 9B-9D), and the fourth spin of the reel 570 would include no symbol clumps. Of course, in a five-reel slot machine, each of the reels (or only a subset of the reels) may include this type of configuration for creating symbol clumps. And, the types of symbol clumps that are created on the reels during each spin may be the same (e.g., all clumps include the "M1" symbol) or different (e.g., the clump on the first reel includes "M1" symbols, the clump on the second reel includes "M2" symbols, the clump on the third reel includes "M1" symbols, the clump on the fourth reel includes "L2" symbols, etc). In any event, the number of total symbol locations on each of the reels would remain constant.

Figure 10A:
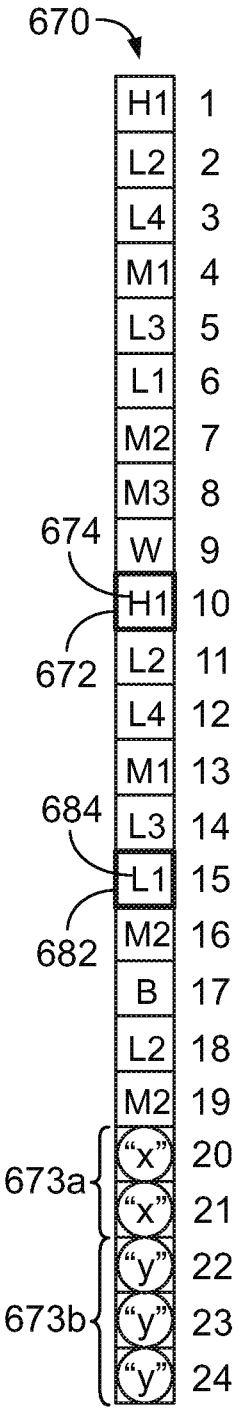
FIGS. 10A-10B set forth a sixth diagrammatic illustration of the altering of one of the plurality of reels in the wagering game.
Figure 10B:
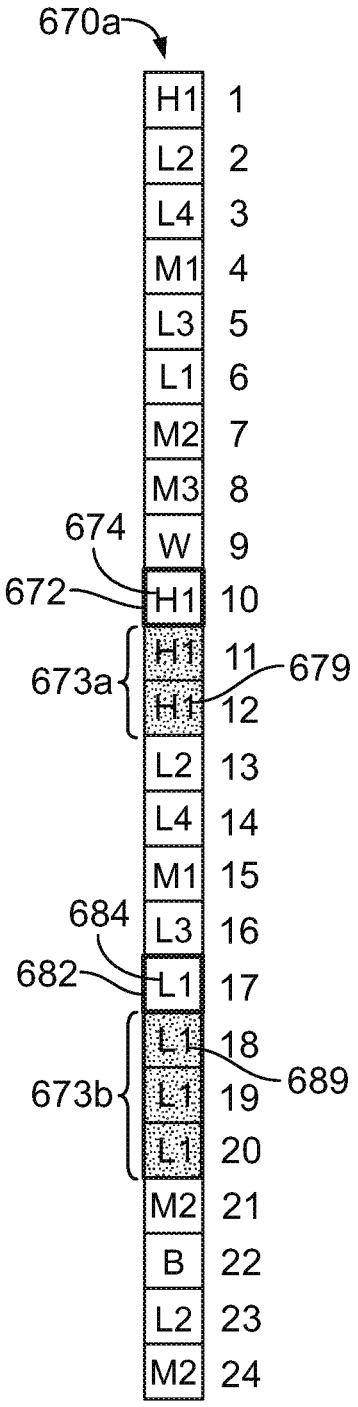

FIGS. 10A and 10B illustrate an alternative embodiment that is similar to FIG. 9, except that the reel 670 includes two variable symbol groupings 673*a* and 673*b*. The reel 670 has twenty-four (24) symbol locations that remain fixed in number from spin to spin. A first selected symbol location 672 includes an "H1" symbol 674, while a second selected symbol location 682 includes an "L1" symbol 684. As shown in FIG. 10B, an altered reel 670*a* is created by the movement of the first variable symbol grouping 673*a* directly below the first selected symbol location 672 and the movement of the second variable symbol grouping 673*b* directly below the second selected symbol location 682. The first variable symbol grouping 673*a* is then filled with the added "H1" symbols 679. Similarly, the second variable symbol grouping 673 is then filled with the added "L1" symbols 689. Accordingly, the altered reel 670*a* includes a three-symbol clump ("H1" symbols) and a four-symbol clump ("L1" symbols).

The embodiment of FIG. 10 provides for some additional modularity in the design and use of the reel strips compared to the embodiment of FIG. 9. In particular, because there are two variable symbol groupings 673*a* and 673*b*, one of them or both of them can be used to create symbol clumps on any given spin. Thus, in a first spin, the reel 670 may have no symbol clumps. In the second spin, the reel 670 may have only a three-symbol clump. In a third spin, the reel 70 may have only a two-symbol clump. In a fourth spin, the reel 670 may include a two-symbol clump and a three-symbol clump. In a fifth spin, the reel 670 may include a six-symbol clump, which can be developed if the same symbol location is selected for both the first variable symbol grouping 673*a* and the second variable symbol grouping 673*b* and one clump extends upwardly from the selected symbol location, while a second clump extends downwardly from the same selected symbol location to help form a larger, oversized clump of the same symbol.

Furthermore, if the reel 670 in FIG. 10A also included a third variable symbol grouping 673 with only a single symbol location (i.e., modified to have twenty-five (25) fixed symbol locations), it would then be possible to create symbol clumps that include anywhere from a two-symbol clump to a seven-symbol clump. In other words, by having three variable symbol groupings 673 (with one symbol location, two symbol locations, and three symbol locations, respectively) different combinations of the variable symbol groupings 673 could be overlaid onto a single selected symbol location to create different lengths to the clump. For example, a two-symbol clump would be created by adding the variable symbol grouping 673 having one symbol location adjacent to a selected symbol location. A five-symbol clump would be created by adding (i) the variable symbol grouping 673 having one symbol location and (ii) the variable symbol grouping 673 having three symbol locations adjacent to the selected symbol location.

In summary, the embodiment of FIG. 10 illustrates that a single reel can have multiple variable symbol groupings 673 and that the variable symbol groupings 673 can be different lengths. Additionally, the embodiments of FIG. 10 have been described to include the possibility of multiple variable symbol groupings 673 been placed onto a single selected symbol location.

In any of the embodiments, additional visual effects may be used to highlight the newly added symbols and/or symbol locations to the player. Increased brightness on added symbols, flashing or blinking effects on added symbols, and borders around additional symbol locations are just a few of the ways to highlight the newly added symbols and/or symbol locations to the player.

Any of the methods described herein can include machine readable instructions for execution by: (a) a processor, (b) a controller, and/or (c) any other suitable processing device. Any algorithm, software, or method disclosed herein can be embodied in software stored on a tangible medium such as, for example, a flash memory, a CD-ROM, a floppy disk, a hard drive, a digital versatile disk (DVD), or other memory devices, but persons of ordinary skill in the art will readily appreciate that the entire algorithm and/or parts thereof could alternatively be executed by a device other than a controller and/or embodied in firmware or dedicated hardware in a well known manner (e.g., it may be implemented by an application specific integrated circuit (ASIC), a programmable logic device (PLD), a field programmable logic device (FPLD), discrete logic, etc.). Also, some or all of the machine readable instructions represented in any flowchart depicted herein may be implemented manually. Further, although specific algorithms are described with reference to flowcharts depicted herein, persons of ordinary skill in the art will readily appreciate that many other methods of implementing the example machine readable instructions may alternatively be used. For example, the order of execution of the blocks may be changed, and/or some of the blocks described may be changed, eliminated, or combined.

While many preferred embodiments and best modes for carrying out the present invention have been described in detail above, those familiar with the art to which this invention relates will recognize various alternative designs and embodiments for practicing the invention within the scope of the appended claims.

What is claimed is:

1. A gaming machine primarily dedicated to playing at least one casino wagering game, comprising:

an electronic display device configured to display a plurality of symbol-bearing reels and an array of symbol positions, at least one reel of the plurality of symbol-bearing reels including a plurality of adjacent symbol locations and a variable symbol group, each symbol location of the plurality of adjacent symbol locations being associated with a certain symbol and being connected to an adjacent symbol location along at least one of a respective top or bottom edge, the variable symbol group occupying a first set of adjacent symbol locations of the plurality of adjacent symbol locations and including an identical clumping symbol in each symbol location of the variable symbol group;

one or more electronic input devices;

a controller configured to perform the operations of:

detecting, via at least one of the one or more electronic input devices, a physical item associated with a monetary value that establishes a credit balance;

initiating the casino wagering game in response to an input indicative of a wager covered by the credit balance;

spinning and stopping the plurality of symbol-bearing reels to land symbols on the reels in the symbol positions of the array, wherein as the at least one reel spins, the variable symbol group moves from the first set to a randomly selected second, different set of adjacent symbol locations of the plurality of adjacent symbol locations; and receiving, via at least one of the one or more electronic input devices, a cashout input that initiates a payout from the credit balance.

2. The gaming machine of claim 1, wherein the clumping symbol matches a symbol at a symbol location in the second set of adjacent symbol locations of the plurality.

3. The gaming machine of claim 1, wherein the clumping symbol is selected from the symbols associated with the symbol locations of the plurality.

4. The gaming machine of claim 1, wherein the clumping symbol matches a symbol that is adjacent to the selected second set of adjacent symbol locations.

5. The gaming machine of claim 1, wherein the identical clumping symbol in each symbol location of the variable symbol group is displayed as a single enlarged clumping symbol occupying a plurality of locations of the variable symbol group.

6. The gaming machine of claim 1, wherein randomly selecting the second set of symbol locations includes randomly selecting one symbol location of the plurality and moving the variable symbol group to occupy adjacent symbol locations below the selected one symbol location.

7. The gaming machine of claim 1, wherein randomly selecting the second set of symbol locations includes randomly selecting one symbol location of the plurality and moving the variable symbol group to occupy adjacent symbol locations above the selected one symbol location.

8. The gaming machine of claim 1, wherein the at least one reel of the plurality of symbol-bearing reels further includes a second variable symbol group distinct from the variable symbol group, the second variable symbol group occupying a second set of adjacent symbol positions separated from the first set, the second variable symbol group including, in each symbol location of the second variable symbol group, a second identical clumping symbol that is different from the identical clumping symbol in the variable symbol group.

9. A method of operating a gaming machine primarily dedicated to playing at least one casino wagering game, the gaming machine including an electronic display device, one or more electronic input devices, and a controller, the method comprising:

detecting, via at least one of the one or more electronic input devices, a physical item associated with a monetary value that establishes a credit balance;

initiating, via the controller, the casino wagering game in response to an input indicative of a wager covered by the credit balance;

displaying, via the electronic display device, a plurality of symbol-bearing reels and an array of symbol positions, at least one reel of the plurality of symbol-bearing reels including a plurality of adjacent symbol locations and a variable symbol group, each symbol location of the plurality of adjacent symbol locations being associated with a certain symbol and being connected to an adjacent symbol location along at least one of a respective top or bottom edge, the variable symbol group occupying a first set of adjacent symbol locations of the plurality of adjacent symbol locations and includes an identical clumping symbol in each symbol location of the variable symbol group;

spinning and stopping the plurality of symbol-bearing reels to land symbols on the reels in the symbol positions of the array, wherein as the at least one reel spins, the variable symbol group moves from the first set to a randomly selected second, different set of adjacent symbol locations of the plurality of adjacent symbol locations; and receiving, via at least one of the one or more electronic input devices, a cashout input that initiates a payout from the credit balance.

10. The method of operating the gaming machine of claim 9, wherein the clumping symbol matches a symbol at a symbol location in the second set of adjacent symbol locations of the plurality.

11. The method of operating the gaming machine of claim 9, wherein the clumping symbol is selected from the symbols associated with the symbol locations of the plurality.

12. The method of operating the gaming machine of claim 9, wherein the clumping symbol matches a symbol that is adjacent to the selected second set of adjacent symbol locations.

13. The method of operating the gaming machine of claim 9, wherein the identical clumping symbol in each symbol location of the variable symbol group is displayed as a single enlarged clumping symbol occupying a plurality of locations of the variable symbol group.

14. The method of operating the gaming machine of claim 9, wherein randomly selecting the second set of symbol locations includes randomly selecting one symbol location of the plurality and moving the variable symbol group to occupy adjacent symbol locations below the selected one symbol location.

15. The method of operating the gaming machine of claim 9, wherein randomly selecting the second set of symbol locations includes randomly selecting one symbol location of the plurality and moving the variable symbol group to occupy adjacent symbol locations above the selected one symbol location.

16. The method of claim 9, wherein the at least one reel of the plurality of symbol-bearing reels further includes a second variable symbol group distinct from the variable symbol group, the second variable symbol group occupying a second set of adjacent symbol positions separated from the first set, the second variable symbol group including, in each symbol location of the second variable symbol group, a second identical clumping symbol that is different from the identical clumping symbol in the variable symbol group.

17. A gaming system, comprising:

a gaming machine primarily dedicated to playing at least one casino wagering game, the gaming machine including an electronic display device and one or more electronic input devices; and a controller configured to perform the operations of:

detect, via at least one of the one or more electronic input devices, a physical item associated with a monetary value that establishes a credit balance;

initiate the casino wagering game in response to an input indicative of a wager covered by the credit balance;

display, via the electronic display device, a plurality of symbol-bearing reels and an array of symbol positions, at least one reel of the plurality of symbol-bearing reels including a plurality of adjacent symbol locations and a variable symbol group, each symbol location of the plurality of adjacent symbol locations being associated with a certain symbol and being connected to an adjacent symbol location along at least one of a respective top or bottom edge, the variable symbol group occupying a first set of adjacent symbol locations of the plurality of adjacent symbol locations and including an identical clumping symbol in each symbol location of the variable symbol group;

spin and stop the plurality of symbol-bearing reels to land symbols on the reels in the symbol positions of the array, wherein as the at least one reel spins, the variable symbol group moves from the first set to a randomly selected second, different set of adjacent symbol locations of the plurality of adjacent symbol locations; and receive, via at least one of the one or more electronic input devices, a cashout input that initiates a payout from the credit balance.

18. The gaming system of claim 17, wherein the identical clumping symbol in each symbol location of the variable symbol group is displayed as a single enlarged clumping symbol occupying a plurality of locations of the variable symbol group.

19. The gaming system of claim 17, wherein randomly selecting the second set of symbol locations includes randomly selecting one symbol location of the plurality and moving the variable symbol group to occupy adjacent symbol locations above or below the selected one symbol location.

20. The gaming system of claim 17, wherein the at least one reel of the plurality of symbol-bearing reels further includes a second variable symbol group distinct from the variable symbol group, the second variable symbol group occupying a second set of adjacent symbol positions separated from the first set, the second variable symbol group including, in each symbol location of the second variable symbol group, a second identical clumping symbol that is different from the identical clumping symbol in the variable symbol group.

* * * * *